United States Patent [19]

Gruber et al.

[11] Patent Number: 4,850,853

[45] Date of Patent: Jul. 25, 1989

[54] AIR CONTROL SYSTEM FOR A BURNER

[75] Inventors: Thomas J. Gruber, Mayfield Heights; Dale G. Putnat, Mentor; Ernest J. Zajaczkowski, Maple Heights, all of Ohio

[73] Assignee: Hunter Manufacturing Company, Cleveland, Ohio

[21] Appl. No.: 192,390

[22] Filed: May 10, 1988

[51] Int. Cl.[4] ..... F23N 3/00

[52] U.S. Cl. ..... 431/90; 431/117; 431/350; 126/116 A; 239/61; 239/75; 239/127

[58] Field of Search ..... 431/12, 90, 117, 118, 431/264, 350, 351, 352; 126/109, 116 A; 239/61, 62, 63, 67, 75, 127, 413; 236/10

[56] References Cited

U.S. PATENT DOCUMENTS

| | | | |
|---|---|---|---|
| 1,495,437 | 5/1924 | Powers | 431/90 |
| 1,595,013 | 8/1926 | Lithman | 431/90 |
| 1,631,859 | 6/1927 | Goodridge | 239/124 |
| 1,655,246 | 1/1928 | Schermuly | 236/10 |
| 1,923,614 | 8/1933 | Clarkson | 236/10 |
| 2,286,630 | 6/1942 | Landon | 236/1 A |
| 2,397,987 | 4/1946 | Senninger | 236/9 R |
| 3,051,227 | 8/1962 | Robson | 112/116 A |
| 3,076,604 | 2/1963 | Robson | 236/10 |
| 3,269,448 | 8/1966 | Martin | 236/15 R |
| 3,331,424 | 7/1967 | Heinrich | 236/1 A |
| 3,391,866 | 7/1968 | Rohrer | 236/14 |
| 3,404,702 | 10/1968 | Telford | 89/194 |
| 3,797,989 | 3/1974 | Gordon | 431/90 |
| 4,099,488 | 7/1978 | Damon | 122/156 |

*Primary Examiner*—Noah P. Kamen

*Attorney, Agent, or Firm*—Fay, Sharpe, Beall, Fagan, Minnich & McKee

[57] ABSTRACT

An air control assembly for a fuel burner having a combustion chamber and a nozzle includes a control device which controls the amount of air that flows into the burner and an assembly dependent on fuel pressure which actuates the control device. A fuel inlet path is provided for communicating fuel to the nozzle and a fuel return path is provided for communicating excess fuel away from the nozzle. The assembly dependent on fuel pressure includes a piston and rod device adapted for reciprocation in a piston chamber. A nozzle block is provided in which the piston chamber is defined and the nozzle is supported.

18 Claims, 10 Drawing Sheets

AIR CONTROL SYSTEM FOR A BURNER

BACKGROUND OF THE INVENTION

This invention generally pertains to control assemblies. More specifically, the present invention relates to a burner control assembly.

The invention is particularly applicable to an air control system for a burner which is used in a heat exchanger of a movable combustion heater that provides heated air to a confined space. However, it will be appreciated by those skilled in the art that the invention has broader applications and may also be useful in burners adapted for a wide variety of other applications outside the combustion heater field.

It is known to use movable air heaters for heating confined spaces such as shelters used by the military, trailers and a variety of portable buildings of various types. These heaters generally provide a fuel tank, a heat exchanger assembly, a fan, and an engine, for pumping the fuel and driving the fan, on a trailer. However, such air heaters have not been completely satisfactory for heating confined spaces because they have been operated in an on/off manner in accordance with sensed air temperature. This type of heater operates at a maximum heating capacity and is alternately fired and shut off in response to a sensed air temperature that is, respectively, below and above a comfort zone in the space. A conventional heater of this type not only requires a relatively long warm up period but also results in the discharge of air at excessively high temperatures into the space after warm up.

It would be desirable to provide a heater with an automatic means for controlling the amount of fuel flow into a burner nozzle in a modulating fashion so as to obtain a selected discharge air temperature during the entire operation of the heater.

Another problem with conventional air heaters is that the air flow remains relatively constant due to the use of single speed fan driven by the engine even when the fuel flow is reduced because less heat is required. This leads to a large amount of excess air being supplied to the burner, which, in turn, leads to wide swings in the air/fuel ratio and hence poor combustion at lower fuel flows. Because so much extra air is introduced into the burner at low fuel flows, the combustion flame burns cool and produces excessive carbon monoxide levels and unburned hydrocarbons due to the excess air and low combustion temperature. Incomplete combustion also may result in the deposition of carbon on the inner Walls and passages of the heat exchanger. Also, more fuel is required since all the excess air needs to be heated by the combustion process. A net savings of fuel could be obtained if the air flow to the burner could be limited along with the fuel flow since a hotter combustion flame would then be provided leading to a more efficient heat transfer process.

It would therefore be advantageous to provide an automatic means for controlling the amount of air flowing into a combustion chamber of a burner in relation to the amount of fuel flowing through a burner nozzle thereof in order to regulate the combustion process in the burner.

Accordingly, it has been considered desirable to develop a new and improved burner assembly which would overcome the foregoing difficulties and others and meet the above-stated needs while providing better and more advantageous overall results.

BRIEF SUMMARY OF THE INVENTION

In accordance with the present invention, a new and improved air control assembly for a burner is provided.

More specifically in accordance with the invention, the assembly comprises a fuel burner including a combustion chamber and a nozzle, a fuel inlet means for communicating fuel to the nozzle and a fuel return means for communicating excess fuel away from the nozzle. An air control means is provided for controlling the amount of air which flows into the burner. A means dependent on fuel pressure is provided for actuating the air control means. The latter means comprises a piston and rod assembly which is adapted for reciprocation in a piston chamber. The piston chamber is, in turn, defined in a nozzle block in which the fuel burner nozzle is supported.

According to another aspect of the present invention, the fuel inlet means is partially defined in the nozzle block and comprises a fuel inlet line which communicates with the burner nozzle and the fuel outlet means is partially defined in the nozzle block and comprises a fuel outlet line which communicates with the burner nozzle. The fuel outlet line is spaced from the fuel inlet line. Preferably, the fuel outlet line communicates with the piston chamber so that fuel pressure in the fuel outlet line can actuate the piston.

According to still another aspect of the present invention, the assembly further comprises an actuator bar pivotally secured to the nozzle block at a first end. A housing is provided in which a second end of the actuator bar is slidably held. A control plate is provided to which the housing is secured, the control plate being, in turn, rotatably secured to a wall of the fuel burner.

According to yet another aspect of the invention, the assembly further comprises a biasing means for resiliently biasing the actuator bar, and hence the control plate, towards a first end position. Preferably, the control plate is provided with spaced apertures and the fuel burner wall, to which the control plate is rotatably secured, is similarly provided with spaced apertures. The control plate apertures are moved into and out of registration with the burner apertures by the means dependent on fuel pressure in order to control the amount of air flowing into the combustion chamber.

According to still yet another aspect of the invention, the assembly further comprises a fuel controller which regulates the amount of fuel which flows through the fuel return means. The fuel controller preferably comprises a valve chamber including a bore and a valve seat, a needle valve adapted to reciprocate in the valve chamber and an adjusting means for adjusting a range of the motion of the needle valve in the valve chamber. The adjusting means, in turn, preferably comprises a control rod secured at one end to the needle valve and a bimetallic means for regulating the motion of the control rod. The bimetallic means is operably connected to the control rod.

According to a further aspect of the invention, a burner assembly is provided.

More specifically in accordance with this aspect of the invention, the assembly comprises a burner housing having a combustion chamber defined therein and a fuel-primary air injection nozzle communicating with the combustion chamber. A first supply means admits fuel and primary air to the nozzle and a second supply means admits secondary air into the combustion chamber. A first control means is provided for controlling the amount of fuel which is bypassed around the first supply means. A second control means is provided for controlling the amount of secondary air which is admitted by the second supply means into the combustion chamber.

According to a still further aspect of the invention, a method for regulating a burner is provided.

More specifically in accordance with this aspect of the invention, the method comprises the steps of providing a heat exchanger which includes a burner having a combustion chamber, a fuel and primary air inlet, and a secondary air inlet, and allowing fuel and primary air to flow into the combustion chamber. The fuel is thereupon combusted. The amount of fuel flowing into the combustion chamber is sensed and the amount of secondary air which flows into the combustion chamber is controlled as a function of the fuel flow sensed.

One advantage of the present invention is the provision of a new and improved burner control assembly.

Another advantage of the present invention is the provision of a means to control the flow of air into a burner by use of a fuel pressure sensed in a fuel return line communicating with a dump port of a burner nozzle.

Still another advantage of the present invention is the provision of a novel temperature responsive means that is located at an air output of a heater device for restricting and opening a fuel flow path in a fuel return line of a burner nozzle to control the amount of fuel flowing through the nozzle.

Yet another advantage of the present invention is the provision of an air control assembly and a fuel control assembly for a burner used in a heat exchanger of a movable combustion heater.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts, preferred embodiments of which will be described in detail in this specification and illustrated in the accompanying drawings which form a part hereof and wherein.

DETAILED DESCRIPTION OF THE PREFERRED EMBODIMENTS

Figure 1:
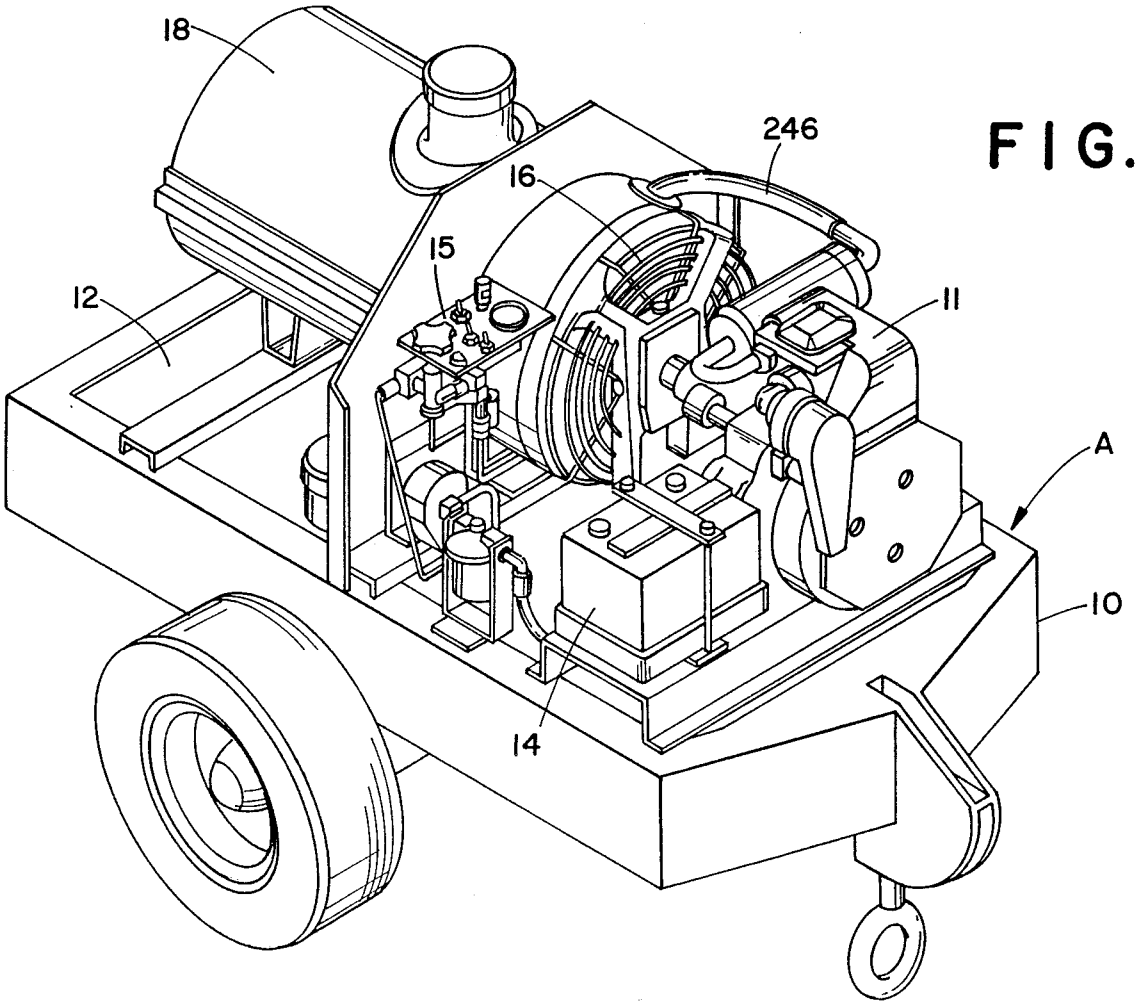
FIG. 1 is a perspective view of a movable combustion heater apparatus which utilizes the burner control assembly of the present invention.

Referring now to the drawings, wherein the showings are for purposes of illustrating preferred embodiments of the invention only, and not for purposes of limiting same, FIG. 1 illustrates the subject new control assembly for a fuel burner in the environment of a movable combustion heater apparatus A. While the burner control assembly will be specifically described in connection with such a heater apparatus, it should be recognized that the control assembly can be used in many other types of burner environments a well.

The movable combustion heater apparatus A includes a trailer 10 supporting an internal combustion engine 11 which receives fuel from a fuel tank 12 housed on the trailer. The engine is actuated by a battery 14 and is controlled by a control panel 15. A fan 16 is rotated by the engine 11 so that the fan can deliver air to a heat exchanger 18, in which is positioned a burner assembly (not visible in FIG. 1).

Figure 2:
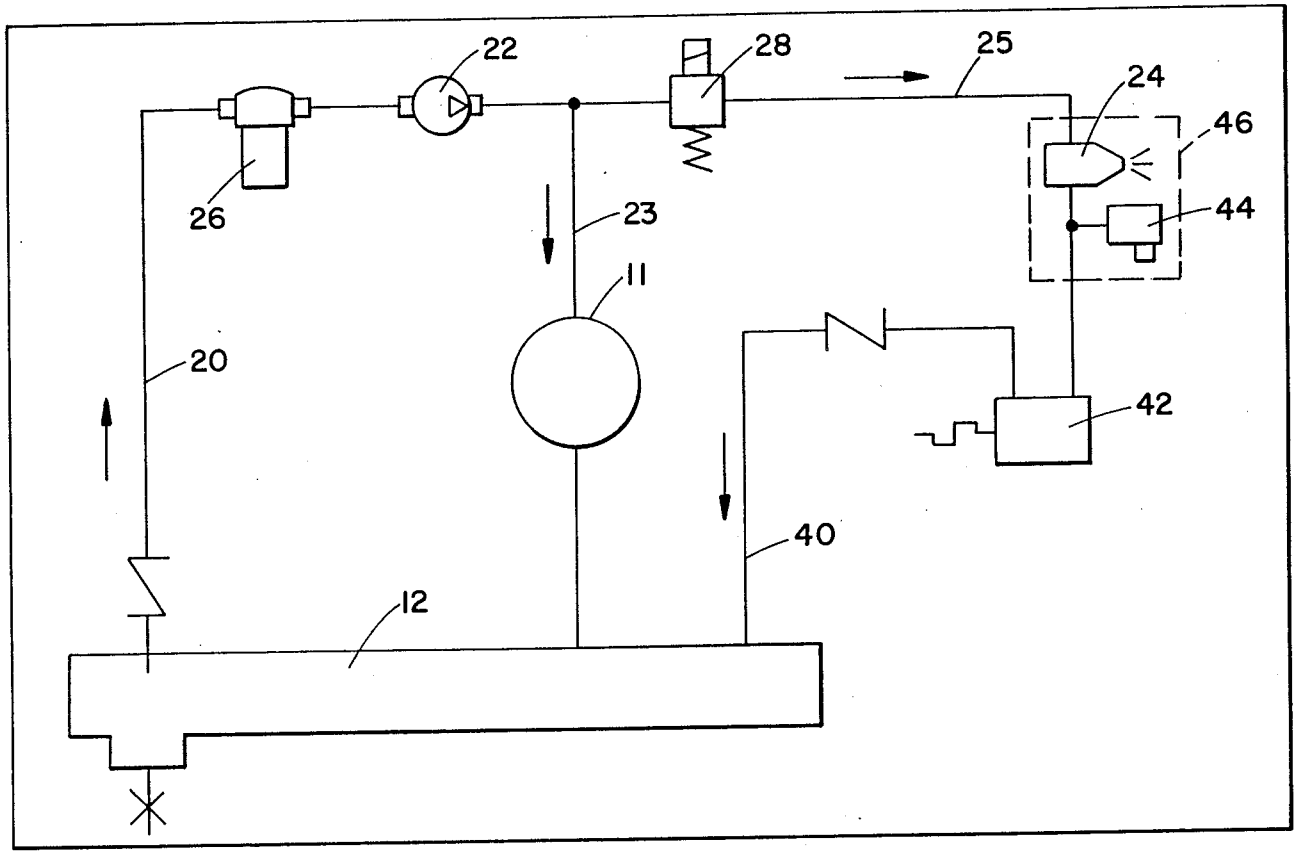
FIG. 2 is a schematic diagram of a fuel system of the combustion heater apparatus of FIG. 1.

With reference now to FIG. 2, communicating the engine 11 and the fuel tank 12, is a suction line 20, in which is positioned a fuel pump 22 that can be powered by the engine 11, and an engine inlet line 23. The pump 22 provides fuel to the engine 11 as well as to a burner nozzle 24 located downstream from the engine inlet line 23 in a fuel inlet line 25. Preferably, also provided in the fuel inlet line 25 are a fuel filter 26 and a solenoid valve 28. The latter regulates the flow of fuel to the nozzle 24. The burner nozzle 24 is of the return fuel flow type which does not use all of the fuel pumped to it. Therefore, a certain portion of the fuel exits the nozzle 24 and flows into a fuel return line 40 which leads from the nozzle back to the fuel tank 12. Positioned in the fuel return line 40 is a fuel control valve 42. Communicating with the fuel return line 40 is a shutter control valve 44. The burner nozzle 24 and the shutter control valve 44 are preferably housed in a nozzle block 46 which is illustrated schematically in FIG. 2 and is more clearly shown in FIGS. 4 and 5.

Figure 3:
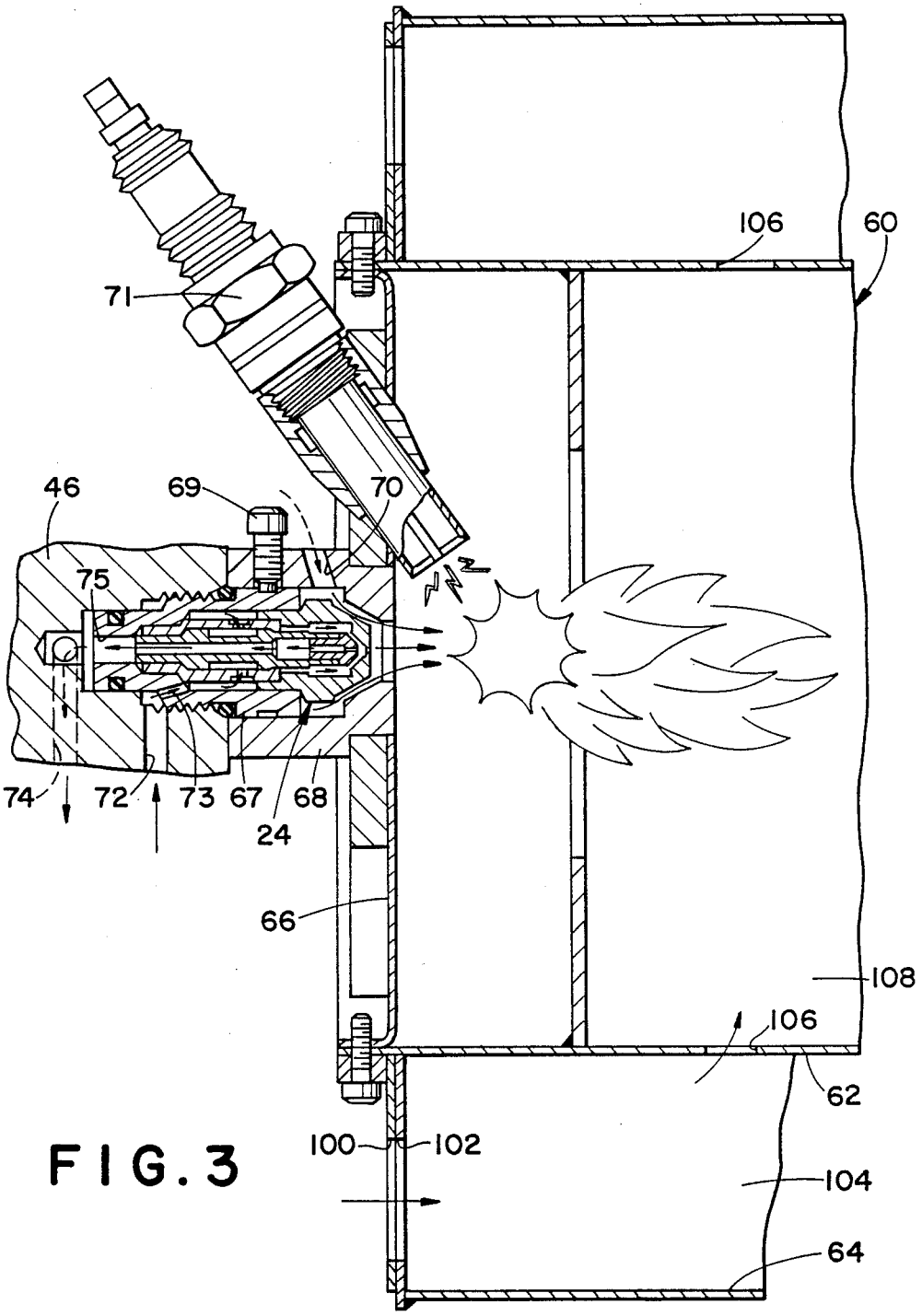
FIG. 3 is an enlarged cross sectional view, shown partially broken away, of a burner and a nozzle therefor, with the nozzle being held in a nozzle block, according to the present invention.

With reference now to FIG. 3, the burner nozzle 24 delivers fuel to a burner 60 which is comprised of a substantially cylindrical inner wall 62 and a concentric cylindrical outer wall 64 spaced therefrom. A back wall 66 is also provided. The nozzle 24 is secured in a housing 67 which is threaded into the nozzle block 46. An outer housing 68 is fastened to the burner back wall 66 and a suitable fastening means 69 is used to secure the nozzle block 46, by way of the housing 67, to the housing 68 and hence the burner back wall. An air inlet aperture 70 is provided in the outer housing 68 to deliver primary air, pressurized by the fan 16, to the burner 60 through the gap between the nozzle 24 and the outer housing 68. A suitable conventional ignition means 71 extends through the back wall 66 to deliver an ignition spark to the fuel and air mixture flowing into the burner from the nozzle.

Figure 4:
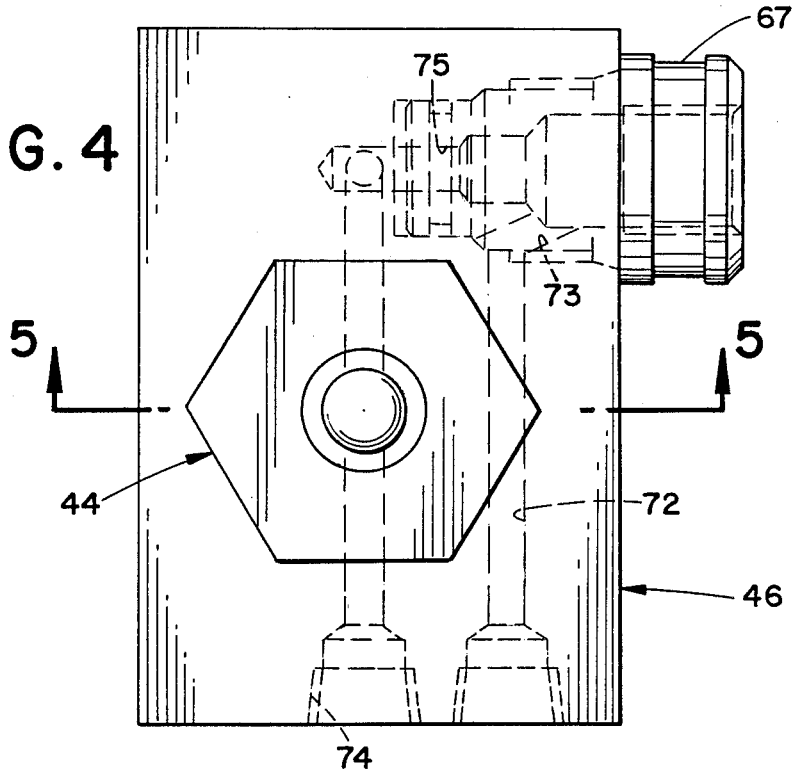
FIG. 4 is a top plan view of the nozzle block of FIG. 3 according to the present invention.

With reference now also to FIG. 4, the nozzle block 46 includes a fuel inlet line 72 that provides a liquid fuel, which can be diesel fuel, gasoline, oil, or a similar combustible liquid fuel, to the burner nozzle head through a suitable aperture 73 in the housing 67. A fuel outlet line 74 is provided in the nozzle block in spaced relation to the inlet line 72, for carrying away the excess unburned fuel from the nozzle. A fuel return aperture 75 in the housing 67 communicates excess fuel from the nozzle 24 to the fuel outlet line 74. The nozzle block fuel inlet line 72 communicates with the fuel inlet line 25 leading to the nozzle block and the block outlet line 74 communicates with the fuel return line 40, as shown in FIGS. 2 and 6.

Figure 5:
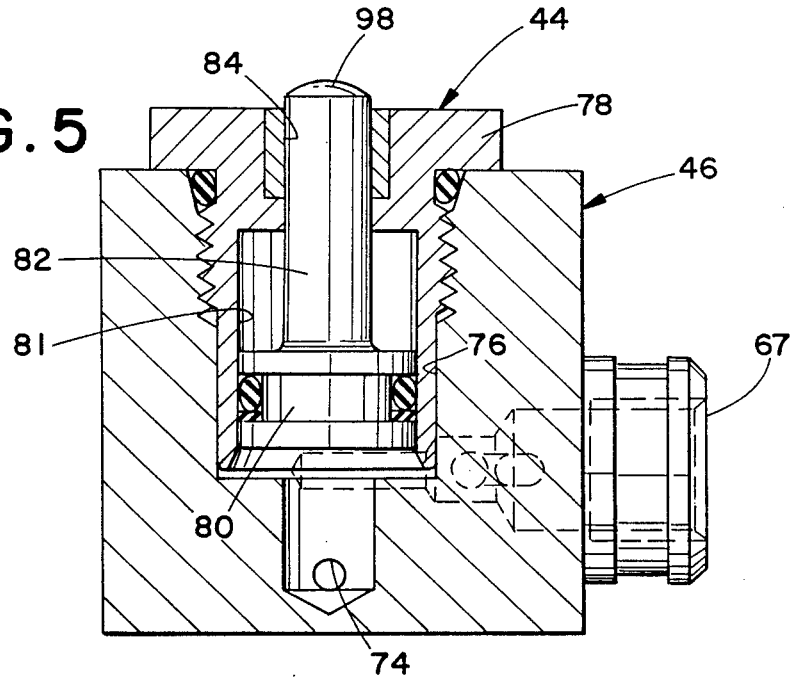
FIG. 5 is a cross-sectional view along lines 5—5 of the nozzle block of FIG. 4.

With reference now also to FIG. 5, the nozzle block has disposed therein a chamber 76 that communicates with the outlet line 74 and into which the shutter control valve 44 is placed. The control valve 44 includes a piston retainer member 78 fastened in a suitable selectively detachable manner in the chamber 76 of the nozzle block 46. A piston 80 is mounted for reciprocation in a bore 81 of the retainer 78. Fastened to the piston 80 is a piston rod 82 a free end of which is adapted to extend out through an upper aperture 84 of the retainer 78.

Figure 6:
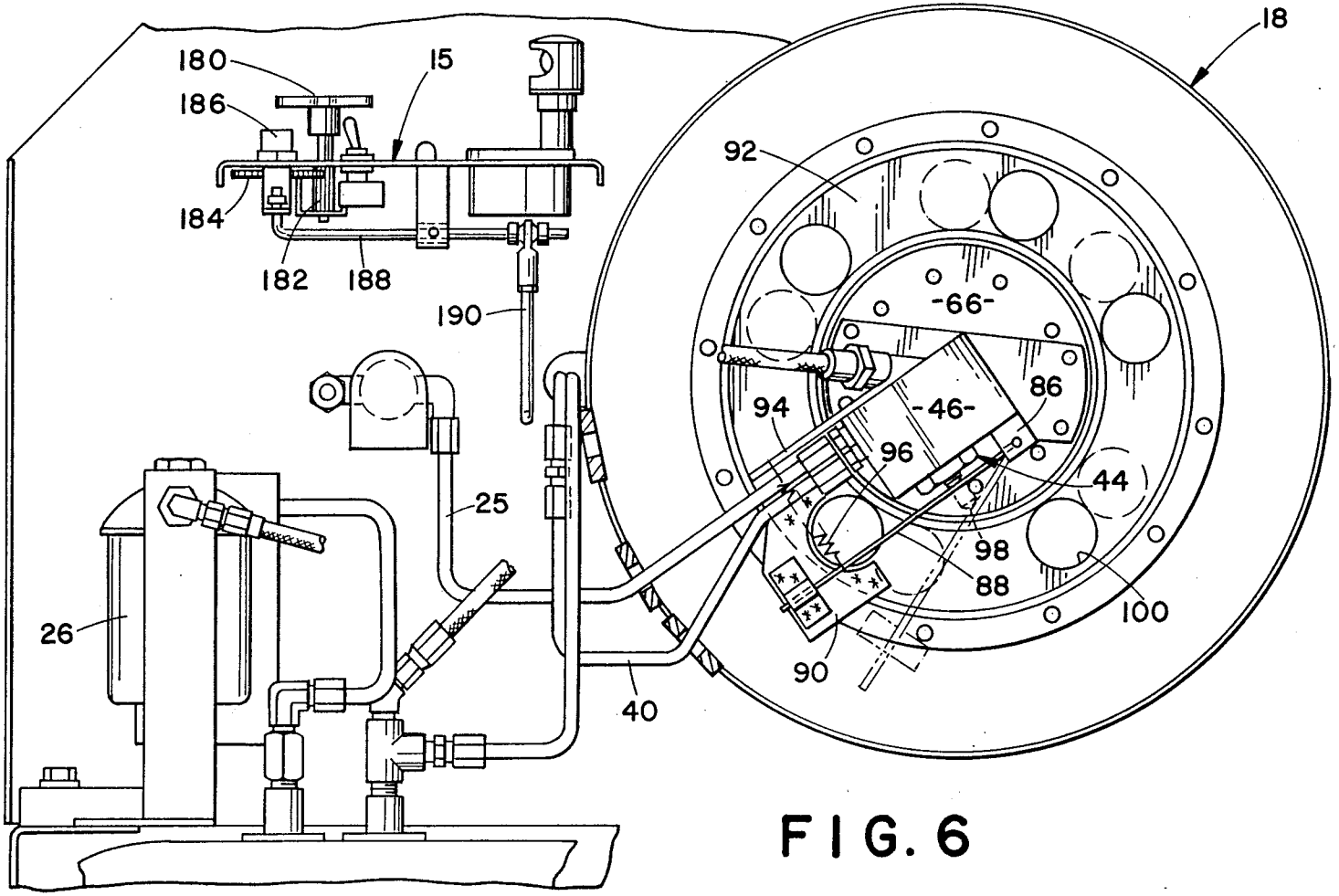
FIG. 6 is an enlarged end elevational view of the combustion heater of FIG. 1, with several parts removed for clarity, in order to illustrate the nozzle block and a heat exchanger together with various control means therefore.

With reference now also to FIG. 6, the nozzle block 46 is illustrated as being secured to the burner back wall 66. Normally, the nozzle block 46 and the wall 66 are not visible in the combustion heater apparatus since they are hidden from view by the fan 16 and the engine 11 as shown in FIG. 1. These have been removed in FIG. 6 in order to illustrate the operation of the shutter control valve 44.

Fastened to the nozzle block 46, above the retainer 78, is an actuator bracket 86 to which is pivotally secured a first end of a bar or an actuator rod 88. A second end of the actuator rod 88 is slidably mounted in a housing 90 that is secured to a control plate such as a shutter plate 92 which is rotatably mounted on the back wall of the burner. Secured to an opposite face of the nozzle block 46 from the actuator bracket 86 is an anchor bar 94. A resilient means 96, such as a spring, is secured to the anchor bar 94 and the actuator rod 88 in order to bias the second end of the actuator rod 88, and hence the shutter plate 92, toward a first end position. The actuator bar 88 is moved away from the first end position by contact with an end face 98 of the piston rod 82 as is illustrated in dotted outline in FIG. 6.

The piston rod 82 of the shutter control valve 44 is caused to advance out of the nozzle block 46 upon an increase in fuel pressure downstream from the burner nozzle. In other words, when fuel pressure in the outlet line 74 increases, the piston 80 is actuated upwardly urging the piston rod end face 98 against the actuator rod 88 thereby pivoting the free end of the actuator rod towards the right in FIG. 6 as shown in dotted outline. This causes a rotation of the shutter plate 92. As is evident from FIG. 6, the shutter is provided with a plurality of spaced apertures 100. As the shutter is rotated, these apertures 100 can be moved into and out of registration with similar suitable apertures 102 located in the burner back wall 66 (see FIG. 3) in order to admit more or less air into the burner. Thus, fuel pressure in the fuel return line leading from the dump port of the burner nozzle directly controls the movement of the shutter plate 92 thereby regulating the flow of air into the burner.

The flow of air through the registering shutter apertures 100 and burner back wall apertures 102 can also be seen in FIG. 3. This air flows into a burner secondary chamber 104 which is defined between the inner and outer walls 62, 64 of the burner. The air then flows through a plurality of suitable apertures 106 on the burner inner wall 62 into a primary combustion chamber 108 of the burner in order to provide secondary air to the combustion process. It is noted that primary combustion air enters the burner along with the fuel.

As less fuel flows back through the outlet line 74, the piston rod 82 is urged upwardly out of the nozzle block 46 due to the increased fuel pressure in the outlet line 74 and the fuel return line 40 caused by the action of the fuel control valve 42 when it limits flow through the return line 40, as explained more fully hereinbelow. This movement of the piston rod rotates the actuator rod 88 and, hence, the shutter plate 92. The shutter apertures 100 are thus moved more into registration with the burner back wall apertures 102 since there is more fuel flowing through the burner nozzle and there is more need for secondary air to complete the combustion process in the primary combustion chamber 108. In contrast, if there is more fuel flow through the outlet line 74, since the fuel control valve 42 does not limit the flow as much in the fuel return line 40, then less fuel is flowing through the nozzle 24 and there is less need for secondary combustion air. Therefore, as the piston rod 82 retracts into the nozzle block 46, due to the lessened fuel pressure in the outlet line 74, the actuator rod 88 pivots back toward the nozzle block 46 and the apertures in the shutter and the burner move out of registration to provide only sufficient secondary air for the burner to complete the combustion process.

Calculations of the quantity of air required for combustion and the quantity of exhaust gas products generated during combustion are frequently needed for sizing system components and as input for efficiency calculations. The precise quantity of air required for complete combustion of a fuel to provide enough oxygen to turn all of the carbon in the fuel to carbon dioxide and all of the hydrogen to water, as well as to oxidize the less prevalent constituents of fuel (such as sulfur to sulfur dioxide), is termed stoichiometric air. Ideally, only the stoichiometric amount of air should be supplied to the burner through the shutter plate apertures 100 since additional air will generally decrease the exhaust gas temperature.

However, excess air in addition to the stoichiometric air must be supplied to most practical combustion systems to insure that complete combustion is achieved. Highest combustion efficiency is usually obtained when just enough excess air is supplied and properly mixed with the fuel to insure complete combustion. In the present apparatus, approximately 50 to 90% excess air is supplied.

In one embodiment of the present invention, to achieve an output of 100,000 BTU's to the heat exchanger, 5.6 lbs. per minute of DF2 (diesel fuel 2) is mixed with 18.66 CFM (cubic feet per minute) of air. The shutter plate 92 is only open enough to admit this volume of air into the burner. At a higher heat requirement of 400,000 BTU's, the shutter will open to allow 68.33 CFM of air to mix with 20.5 lbs. per minute of DF2 fuel. Of course with other fuels, such as gasoline, or other burner constructions, different amounts of air and fuel may be necessary to achieve similar outputs.

Figure 7:
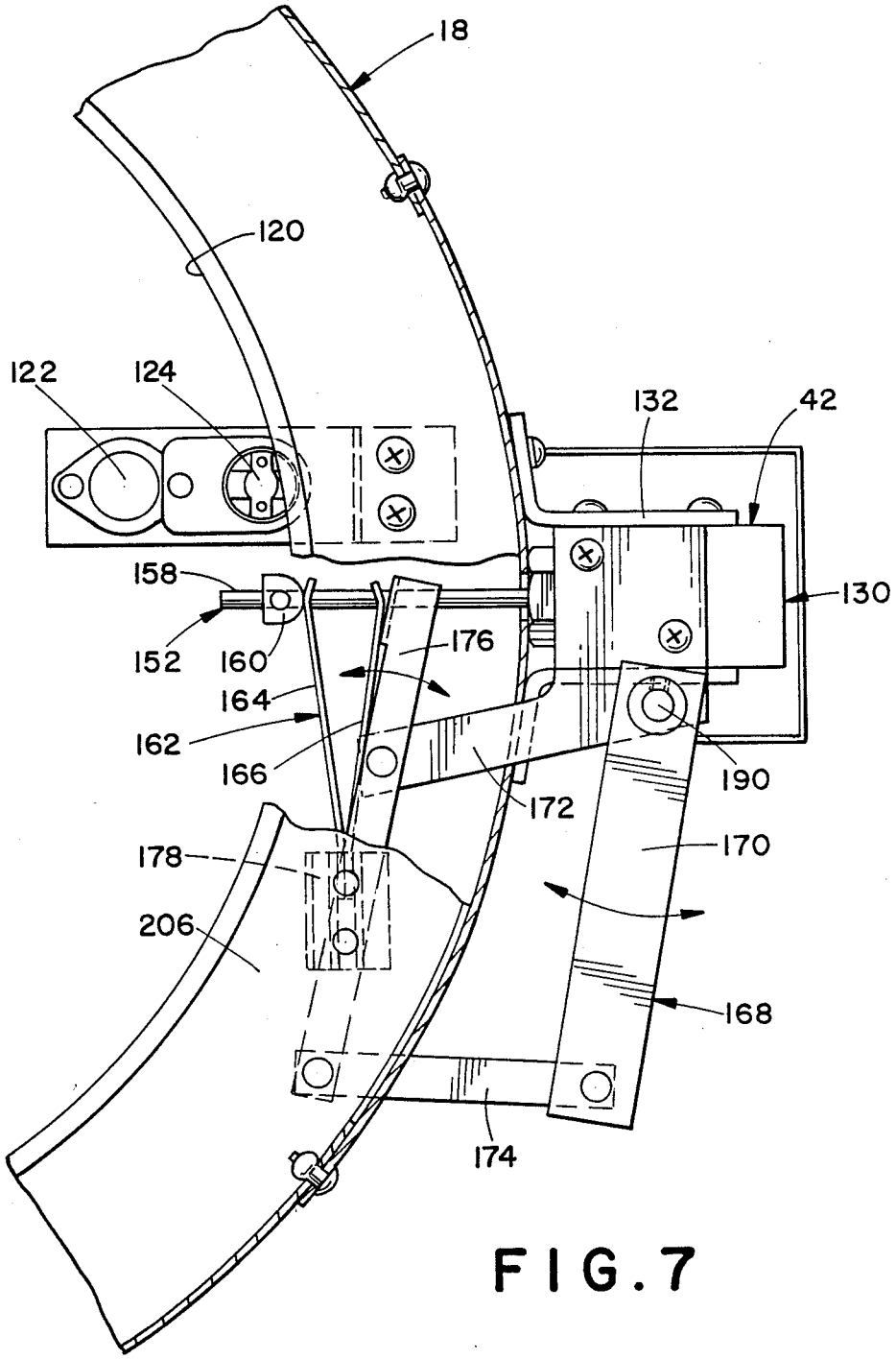
FIG. 7 is an enlarged front elevational view, partially broken away, of a fuel control means according to the present invention as it is secured to the combustion heater of FIG. 1.

With reference now to FIG. 7, the heat exchanger 18, has provided at a hot air outlet 120 thereof, various instrumentation for sensing whether the burner assembly is operating correctly. Such instrumentation can include, if desired, an overheat thermostat 122 as well as a flame sensor 124. In accordance with the present invention, also provided adjacent the hot air outlet end 120 is the fuel control valve 42. This control valve includes a valve block 130 which is suitably secured, such as by brackets 132, to the heat exchanger 18.

Figure 8A:
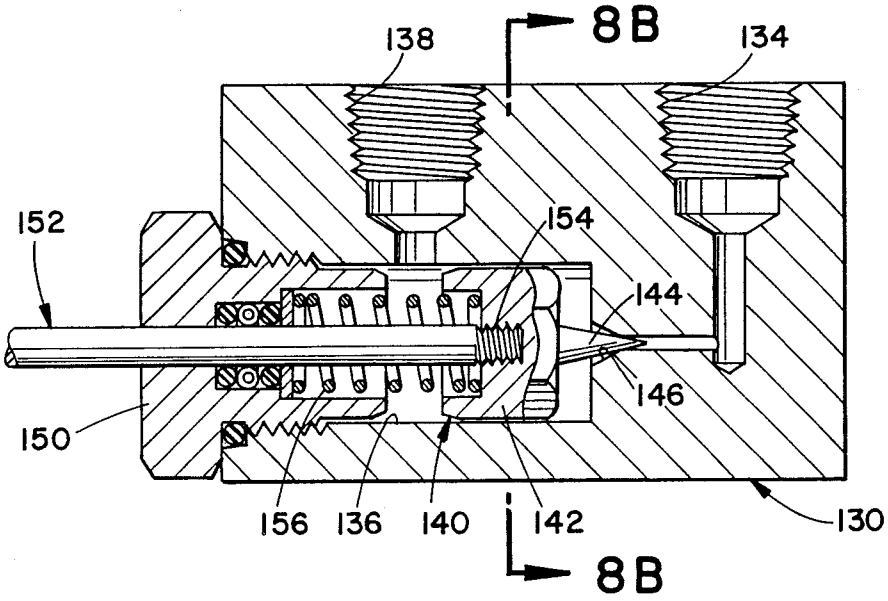
FIG. 8A is an enlarged cross-sectional view through a valve block of the fuel control means of FIG. 7.
Figure 8B:
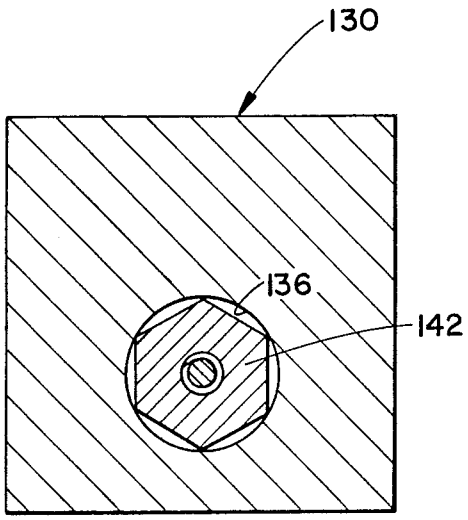
FIG. 8B is a cross-sectional view along lines 8B—8B of the valve block of FIG. 8A.

With reference now also to FIG. 8A, the valve block 130 includes an inlet aperture 134 which communicates with a valve chamber 136, that in turn communicates with an outlet aperture 138. Positioned in the valve chamber is a valve 140 having a body portion 142 and a needle portion 144. The valve needle portion 144 is adapted to sealingly engage a valve seat 146. As is evident from FIG. 8B, whereas the valve body portion 142 is substantially hexagonal in shape, the valve chamber 136 in which the body sits is substantially circular in shape. This construction allows fuel to flow around the body portion 142 when the needle portion 144 is spaced from the valve seat 146.

Also secured in the valve chamber 136 is a rod guide body 150 which is adapted to guide a rod 152 that is configured to slide therein. A first end 154 of the rod is secured to the valve body portion 142 in order to enable the rod to reciprocate the valve 140 as desired. A resilient means 156, such as a spring, can be provided between the rod guide 150 and the valve 140 in order to bias the valve 140 towards engagement of the needle portion 144 with the valve seat 146.

With reference now again to FIG. 7, a second end 158 of the rod 152 is positioned within the hot air outlet end 120 of the heat exchanger 18. Secured adjacent the second end of the rod is a stop member 160. Operatively connected to the rod 152 is a wishbone-shaped bimetallic assembly 162 which includes first and second legs 164,166. A free end of the first leg 164 rests against the stop member 160 and a free end of the second leg 166 rests against a portion of a linkage assembly 168.

The linkage assembly includes a first leg 170 which is pivotally secured at a first end to a support bracket 172 that is affixed to the valve housing 130. A second end of the first leg 170 is pivotally secured to a first end of a second leg 174. A second end of the second leg 174 is, in turn, secured to one end of a third leg 176 to form a "U"-shaped assembly. The third leg 176 is also pivotally secured, in a spaced manner from its securement to the second leg, to an arm extension of the bracket 172. It is also noted that a housing 178, is provided in order to house a second end of the bimetal control assembly 162 and secure same to the heat exchanger 18.

The bimetal control assembly 162 actuates the fuel valve 42 to restrict or open the flow of fuel in the fuel return line 40. In operation, the bimetal control will sense a cold condition of the air exiting the combustion heater at the outlet 120 and cause the fuel control valve 130 to restrict the flow of fuel in the fuel return line. The bulk of fuel which is supplied to the nozzle 24 is thereby caused to be dispensed through the atomizing tip of the nozzle 24 and into the primary combustion chamber 108. As more fuel is thus burned, this will cause a rise in the temperature of the air passing through the heat exchanger 18. When a desired temperature of air has been reached, this will be sensed by the bimetal assembly 162 with the result that the fuel control valve will open further. This will, in turn, cause more fuel to flow through the fuel return valve 42 and less fuel to be atomized at the nozzle 24 thus reducing the heat output of the burner.

The desired temperature of the air coming from the heat exchanger 18 can be set by suitable controls provided on the control panel 15 as illustrated in FIG. 1. the control panel is more clearly illustrated in FIG. 6 as including a handle 180 which, when rotated, causes the turning of a pinion gear assembly 182 and thereby also causes the movement of an actuator gear 184 and a display knob 186 on the control panel. The actuator gear assembly 184 can, through suitable control rods 188, 190, rotate the first leg 170 of the linkage assembly and thereby control the movement of the rod 152.

Thus the bimetal control assembly 162 at the air outlet of the heater enables one to control the amount of heat which is emitted by the heat exchanger 18. The bimetal assembly is interconnected with the needle operated fuel control valve which regulates the flow of fuel in the fuel return line. A high rate of fuel flow in the fuel return line will result in less fuel being burned at the nozzle. In contrast, a low rate of flow in the fuel return line will result in a relatively large amount of fuel being burned at the nozzle.

Figure 9:
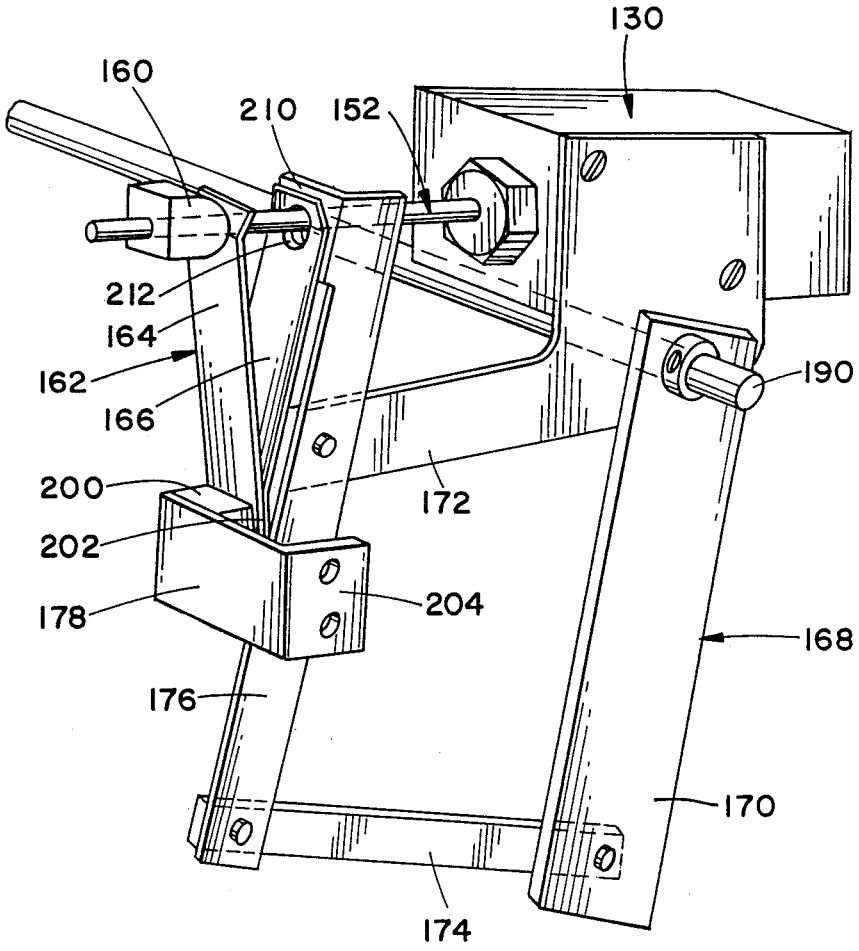
FIG. 9 is a perspective view of the fuel control means of FIG. 7.

As is evident from FIG. 9, the housing 178 of the bimetal assembly includes a block section 200 to which a joint leg section 202 of the bimetal assembly 162 is secured in any suitable conventional manner. The housing 178 is, itself, secured by a flange section 204 to an end wall 206 (see FIG. 7) of the heat exchanger 18. As mentioned, a free end of one leg 164 is positioned against the stop member 160 whereas a free end of the other leg 166 is positioned against a flange 210 of the third leg 176 of the linkage assembly 168. It is evident from FIG. 9 that suitable apertures 212 are provided through the legs 164,166 in order to enable the rod 152 to extend therethrough.

Appropriate shutter control, i.e. the control of air going into the burner 60, is achieved automatically since the shutter control is dictated by the fuel pressure in the fuel return line as described above. Therefore, by varying the setting on the handle 180, the amount of heat which is produced by the heat exchanger 18 can be controlled. It is noted that only the handle 180 needs to be rotated manually since the control of the secondary air flow into the combustion chamber 60 is done automatically by the action of the shutter control valve 44 positioned in the nozzle block 46.

Figure 10:
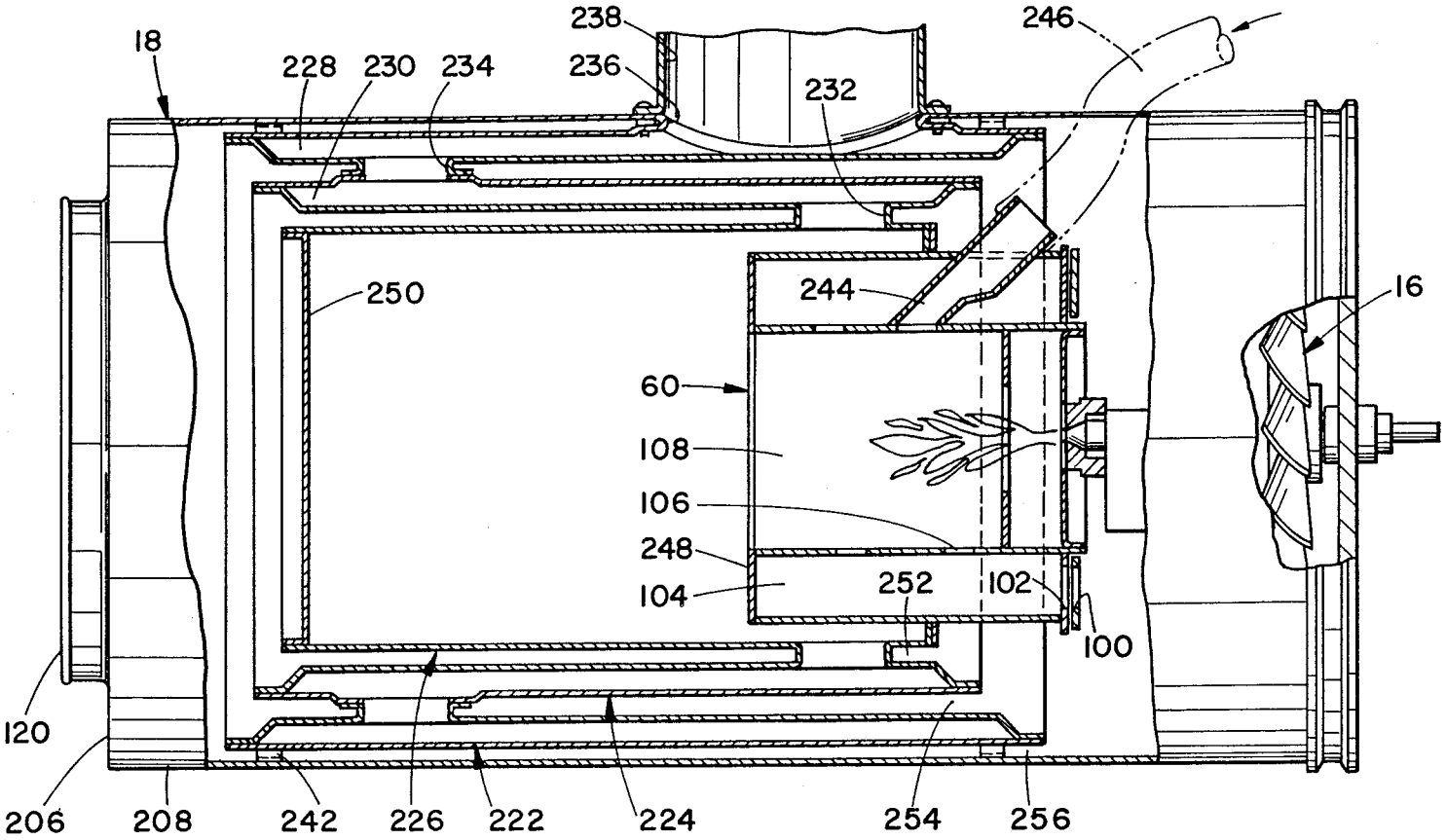
FIG. 10 is a side elevational view, partially in cross section, through the heat exchanger of the combustion heater of FIG. 1; and, FIG. 11 is a schematic diagram of a fuel system of a combustion heater apparatus according to a second preferred embodiment of the present invention.

With reference now to FIG. 10, the heat exchanger 18 is seen to include the outer housing 208 in which are concentrically disposed an outer flare tube assembly 222, an inner flare tube assembly 224 and a primary tube assembly 226. It is noted that the outer and inner flare tube assemblies each include a respective annular space 228, 230 and that suitable connecting tubes 232,234 are provided in order to communicate the primary tube 226 with the inner flare tube assembly 224 and the inner flare tube assembly with the outer flare tube assembly 226. Although only two such inner and outer tubes are disclosed in FIG. 10, there are preferably six such tubes disposed around the periphery of the flare tube assemblies. Additionally, a suitable connecting tube 236 is provided to communicate the outer flare tube assembly with a stack 238 which exhausts the combustion products. Suitable spacers 242 are utilized in order to space the outer flare tube assembly 222 away from the outer housing 208. The inner flare tube assembly 224 is spaced away from the outer flare tube assembly by the connecting tubes 234. Similarly, the primary tube 226 is spaced away from the inner flare tube assembly by the connecting tubes 232. In this way a concentric series of tubes are provided for the heat exchanger.

The burner 60, which is suitably secured to the primary tube 226, is provided with an engine exhaust gas inlet opening 244 which communicates the exhaust from the engine 11 (see FIG. 1) through a suitable conventional engine exhaust gas tube 246. This is useful to allow the heat exchanger to utilize the heat from the exhaust gases and to enable any fuel in the exhaust gases to be completely combusted by being again burned in the burner 60.

Air is urged into the burner 60 by the fan 16 through the aperture 70 in the holder 68 (see FIG. 3) and the cooperating apertures 100,102. Air which flows into the secondary chamber 104 then flows into the primary chamber 108 through apertures 106 since flow downstream in the secondary chamber is blocked by end wall 248. It is noted that flow downstream from the primary chamber 106 into the primary tube 226 is also blocked by end wall 250.

In use, as the injection nozzle 24 injects fuel and primary air, pressurized by the fan 16, is allowed to flow into a primary combustion space of the burner 60 through the gap between the nozzle 24 and the outer housing 68, the fuel and air are combusted. Combustion gases, since they are blocked from traveling downstream through the primary tube 226 by the closed end 250 thereof are constrained to flow through the connecting tubes 232 into the annular inner flare tube assembly 224. From there the gases flow through the connecting tubes 234 into the annular outer flare tube assembly 222. Thereafter the gases flow through the third connecting tube 236 into the stack 238 and out into the atmosphere.

While this is happening, the fan 16 is utilized to blow atmospheric air through the heat exchanger 18. In this regard it can be seen that suitable channels or paths for heat exchange are provided as at 252, 254 and 256. As the air flows through these concentric paths or flow spaces, it picks up heat by contact with the several concentric tubes through which the exhaust gas flows. The thus heated air is then exhausted through the hot air outlet 120 provided on the heat exchanger 18.

Figure 11:
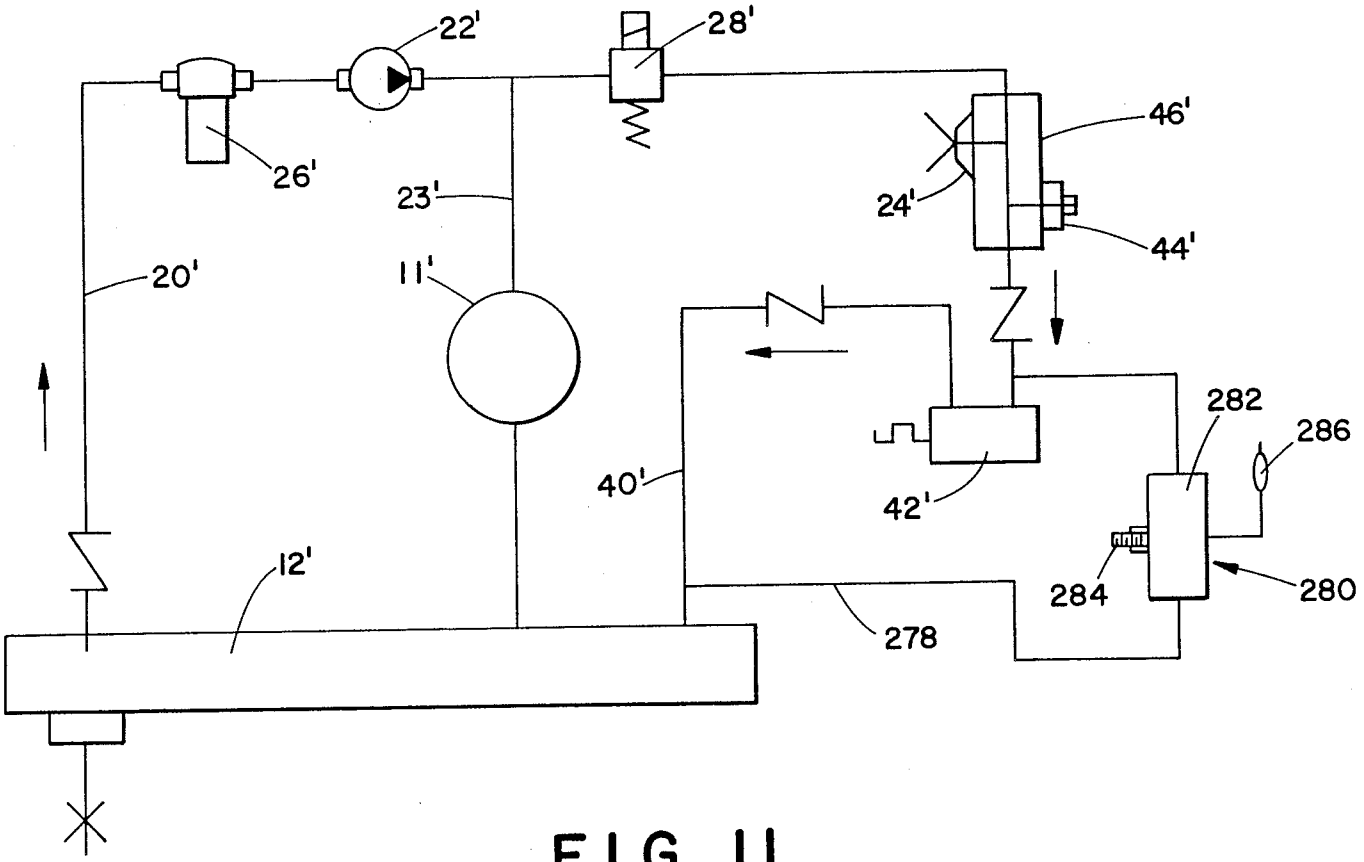

With reference now to the second preferred embodiment of FIG. 11, the invention is there shown as being utilized in combination with an air density compensator valve. For ease of illustration and appreciation of this alternative, like components are identified by like numerals with a primed (') suffix and new components are identified by new numerals.

In this FIGURE, a fuel inlet line 20' communicates an engine 11' with a fuel tank 12' through a fuel filter 26' and a fuel pump 22'. The pump 22' provides fuel to the engine 11' as well as to a burner nozzle 24' located downstream in the fuel line 20' from an engine inlet line 23'. A solenoid valve 28' is preferably also provided in the inlet line 20' to regulate the flow of fuel to the nozzle 24'. The burner nozzle 24' is of the return fuel flow type so that a certain portion of the fuel exits the nozzle 24' and flows into a fuel return line 40' which leads from the nozzle back to the tank 12'. A nozzle block 46' contains not only the nozzle 24' but also a shutter control valve 44'. Downstream from the nozzle block 46' in the fuel return line 40' is located a fuel control valve 42'.

In this embodiment, a second fuel return line 278 is connected between the upstream and downstream legs of the fuel return line 40' around the fuel control valve 42'. Connected in this alternate fuel return line 278 is an air density compensator valve 280. It is the function of this valve to adjust the burner fuel rate so at to maintain a favorable fuel-air ratio whenever the density of air is appreciably affected by either changes in altitude or changes in ambient temperature. The air density compensator valve 280 is placed in parallel with the fuel control valve 42' so that each valve regulates to some extent the flow of fuel from the burner nozzle bypass. The valve includes a valve body 282 as well as a means for manually adjusting the valve, such as an adjusting stem 284 and a means for sensing temperature, such as a temperature sensing element 286.

Such a valve is generally useful since at successively higher altitudes the density of air is correspondingly reduced and in a given volume of air, the amount of oxygen available for combustion is therefore similarly reduced. At higher altitudes, this will result in an excessively rich fuel to air mixture were it not for the provision of the valve 280.

Adjustments in the fuel air ratio are also desirable when changes in air density are occasioned by changes in ambient air pressure. In this case, as the ambient temperature increases, a lower air density prevails and the valve must again act to reduce the combustor fuel flow so as to maintain the most favorable fuel-air ratio.

The air density compensator valve 280 is essentially a pressure regulating valve which controls the burner nozzle bypass fuel pressure within limits calculated to maintain the most favorable combustion fuel-air ratio under any given condition of altitude and ambient temperature. The valve 280 will lower the nozzle bypass pressure, i.e. divert more fuel through the bypass leaving less for actual combustion due to the lowered oxygen content of high altitude air or high temperature (i.e. lower density) air. Since there is no change in combustion air volume, but only a reduction in density and hence less oxygen, the corresponding reduction in burner fuel flow rate maintains the most favorable fuel-air mixture.

Air density compensator valves are known to the art. One suitable such valve is manufactured by the Singer valve division of Eaton Corporation.

Actuating the adjusting stem 284 is a pointer knob. Turning the pointer knob of this known valve results in a raising or lowering of the stem which in turn results in a decrease or increase in a compression of a conventional loading spring that exerts a downward pressure on a diaphragm pad to control the travel of a valve element in relation to a valve seat as is well known in the art. Connected to a lower portion of the valve body 282 is the ambient temperature sensing element 286 which exerts an upward force on a lower diaphragm tending to raise the valve element. This upward force on a lower diaphragm is opposed by the downward force on the loading spring and the upper diaphragm. The nozzle bypass pressure is therefore regulated automatically by ambient temperature through the sensing element 286. The temperature sensing element 286 is so positioned within the heat exchanger as to be responsive to inlet air temperature to the heat exchanger.

The invention has been described with reference to preferred embodiments. Obviously, modifications and alterations will occur to others upon the reading and understanding of this specification. It is intended to include all such modifications and alterations insofar as they come within the scope of the appended claims or the equivalents thereof.

What is claimed is:

1. An air control assembly for a burner, comprising:

a fuel burner including a combustion chamber and a nozzle;

a fuel inlet means for communicating fuel to said nozzle;

an air inlet for communicating a primary air to said nozzle;

a fuel return means for communicating excess fuel away from said nozzle;

an air control means controlling an amount of a secondary air which flows into said burner between full open, full closed and a large number of positions therebetween;

a means dependent on fuel pressure for actuating said air control means, said means dependent on fuel pressure comprising a piston and rod assembly adapted for reciprocation in a piston chamber said piston and rod assembly being able to actuate said air control means to full open, full closed and a large number of positions therebetween; and, a nozzle block in which said piston chamber is defined and in which said fuel burner nozzle is supported.

2. The assembly of claim 1 wherein said fuel inlet means is partially defined in said nozzle block and comprises a fuel inlet line which communicates with said burner nozzle, and wherein said fuel outlet means is partially defined in said nozzle block and comprises a fuel outlet line which communicates with said burner nozzle, said fuel outlet line being spaced from said fuel inlet line.

3. The assembly of claim 2 wherein said fuel outlet line communicates with said piston chamber so that fuel pressure in said fuel outlet line can actuate said piston.

4. The assembly of claim 1 wherein said air control means comprises:

an actuator bar pivotally secured to said nozzle block at a first end;

a housing in which a second end of said actuator bar is slidably held; and, a control plate to which said housing is secured, said control plate being rotatably secured to a wall of said fuel burner.

5. The assembly of claim 4 wherein said air control means further comprises a biasing means for resiliently biasing said actuator bar, and hence said control plate towards a first end position.

6. The assembly of claim 5 wherein said control plate is provided with spaced apertures, and wherein said fuel burner wall to which said control plate is rotatably secured is similarly provided with spaced apertures, wherein said control plate apertures are moved into and out of registration with said burner wall apertures by said means dependent on fuel pressure to control the amount of air flowing into said combustion chamber.

7. The assembly of claim 1 further comprising a fuel controller which regulates the amount of fuel that flows through said fuel return means downstream from said means dependent on fuel pressure and thereby regulates the fuel pressure in said fuel return means and said means dependent on fuel pressure.

8. The assembly of claim 7 wherein said fuel controller comprises:

a valve chamber including a bore and a valve seat;

a needle valve adapted to reciprocate in said valve chamber; and, an adjusting means for adjusting a range of motion of the needle valve in said valve chamber.

9. The assembly of claim 8 wherein said adjusting means comprises:

a control rod secured at one end to said needle valve; and a bimetallic assembly means for regulating the motion of said control rod, said bimetallic assembly means being operably connected with said control rod.

10. A burner assembly comprising:

a burner housing having a combustion chamber defined therein;

a fuel-primary air injection nozzle communicating with said combustion chamber;

a first supply means for admitting fuel and primary air to said nozzle;

a second supply means for admitting secondary air into said combustion chamber;

a first control means form controlling the amount of excess fuel flowing away from said nozzle in a fuel return line;

a second control means for controlling the amount of secondary air which is admitted by said second supply means into said combustion chamber in an infinitely variable fashion from full open to full close as a function of the pressure of fuel in said return line, the flow of fuel out said nozzle being correlated with said pressure.

11. The assembly of claim 10 further comprising a third control means for controlling the amount of fuel flow in said return line.

12. The assembly of claim 11 wherein said third control means comprises a means dependent on air density for regulating fuel flow, said means dependent on air density comprising:

a housing means for defining a valve chamber in which a valve reciprocates;

an adjusting means for adjusting a range of motion of said valve in said housing means valve chamber; and, a temperature sensing means for sensing an ambient air temperature and adjusting said range of motion of said valve in said valve chamber accordingly.

13. The assembly of claim 12 wherein said second control means comprises:

a piston and rod assembly positioned in a piston chamber defined in said nozzle block;

an actuator bar pivotally secured to said nozzle block at a first end and contacted along its length by said piston and rod assembly;

a housing in which a second end of said actuator bar is slidably held; and, a control plate to which said housing is secured, said control plate being rotatably secured to a wall of said fuel burner, wherein said control plate and said burner wall are each provided with spaced apertures, and wherein said control plate apertures are moved into and out of registration with said burner wall apertures by the movement of said actuator bar.

14. The assembly of claim 10 wherein said first control means comprises:

a valve chamber including a bore and a valve seat;

a needle valve adapted to reciprocate in said valve chamber; and, an adjusting means for adjusting a range of motion of said needle valve in said valve chamber.

15. The assembly of claim 14 wherein said adjusting means comprises:

a control rod secured at one end to said needle valve; and, a bimetallic assembly means for regulating a motion of said control rod, said bimetallic assembly means being operably connected to said control rod.

16. An air control assembly for a burner, comprising:

a fuel burner including a combustion chamber and a nozzle;

a fuel inlet means for communicating fuel to said nozzle;

a fuel return means for communicating fuel excess fuel away from said nozzle;

an air control means for controlling an amount of air which flows into said burner;

a means dependent on fuel pressure for actuating said air control means, said means dependent on fuel pressure comprising a piston and rod assembly adapted for reciprocation in a piston chamber;

a nozzle block in which said piston chamber is defined and in which said fuel burner nozzle is supported; and, wherein said air control means comprises:

an actuator bar pivotally secured to said nozzle block at a first end, a housing in which a second end of said actuator bar is slidably held, and a control plate to which said housing is secured, said control plate being rotatably secured to a wall of said fuel burner.

17. The assembly of claim 16 wherein said air control means further comprises a biasing means for resiliently biasing said actuator bar, and hence said control plate towards a first end position.

18. The assembly of claim 17 wherein said control plate is provided with spaced apertures, and wherein said fuel burner wall to which said control plate is rotatably secured is similarly provided with spaced apertures, wherein said control plate apertures are moved into and out of registration with said burner wall apertures by said means dependent on fuel pressure to control the amount of air flowing into said combustion chamber.

* * * * *